United States Patent [19]

Whitfield

[11] Patent Number: 4,947,769

[45] Date of Patent: Aug. 14, 1990

[54] APPARATUS FOR COMBUSTION OF SOLID PARTICULATE FUEL

[76] Inventor: Oliver J. Whitfield, 4206 - 242nd St. SW., Mountlake Terrace, Wash. 98043

[21] Appl. No.: 372,836

[22] Filed: Jun. 27, 1989

Related U.S. Application Data

[63] Continuation-in-part of Ser. No. 325,270, Mar. 17, 1989, abandoned.

[51] Int. Cl.[5] ..... F23G 5/00; F23G 5/12; F23G 5/44; F23G 7/00

[52] U.S. Cl. ..... 110/259; 110/248; 110/258; 126/123

[58] Field of Search ..... 110/258, 259, 248, 118, 110/165 R; 126/173

[56] References Cited

U.S. PATENT DOCUMENTS

| | | | |
|---|---|---|---|
| 2,637,590 | 1/1945 | Lewers et al. | 110/248 |
| 4,007,697 | 2/1977 | Prill | 110/45 |
| 4,430,948 | 2/1984 | Schafer et al. | 110/101 R |
| 4,449,462 | 5/1984 | Robb | 110/288 |
| 4,517,905 | 5/1985 | Chastain et al. | 110/258 X |
| 4,548,194 | 10/1985 | Schafer et al. | 126/110 R |

FOREIGN PATENT DOCUMENTS

| | | | |
|---|---|---|---|
| 28336 | of 1914 | United Kingdom | 110/258 |

*Primary Examiner*—Edward G. Favors

*Attorney, Agent, or Firm*—Christensen, O'Connor, Johnson & Kindness

[57] ABSTRACT

An apparatus for burning solid particulate fuels in a top-fed combustion system that permits the use of fuels that produce large amounts of ash and clinkers. The apparatus displaces the ash and clinkers from the grate which, if not removed, would adversely affect the heat output and efficiency of combustion. The apparatus uses a rotating reciprocating member that removes the ash and clinkers from the grate that supports the solid particulate fuel during combustion.

18 Claims, 4 Drawing Sheets

APPARATUS FOR COMBUSTION OF SOLID PARTICULATE FUEL

This application is a continuation-in-part of prior copending application Ser. No. 07/325,270, filed on Mar. 17, 1989 abandoned. The benefit of the filing date of which is hereby claimed under 35 U.S.C. §120 for the subject matter common to both applications.

TECHNICAL FIELD

The present invention relates to an apparatus for burning solid particulate fuel, particularly fuel in the form of preprocessed pellets.

BACKGROUND OF THE INVENTION

Heaters or stoves with some means of feeding combustible particulate material thereto are well known. Generally, such heaters have been utilized with pulverized coal or some similar combustible particulate material as a fuel source. At one point, such heaters were replaced by oil or gas fueled heaters when gas and oil were in plentiful supply. Due to the increasing cost of gas and fuel oil, increasing attention is again being directed to alternative fuel sources such as wood or other combustible residues. Currently, particular attention is being given to heaters of the type that use preprocessed pelletized fuel sources produced from wood waste, agricultural residue, and the like.

The pelletized fuels are generally burned within a sealable firebox with gases necessary for combustion, usually air, being supplied. In order to effectively provide sufficient amounts of the combustion gases to the pelletized fuel, it is known that the fuel can be supported and distributed on a perforated plate commonly known as a grate with the combustion gases being introduced below the grate and allowed to flow upward through the perforations and into the burning fuel.

The utility of the grate may be adversely effected by ash and clinkers that are produced by the combustion of the pelletized fuel. Often the formation of ash and clinkers is so extensive that the perforations in the grate become clogged or covered, thus restricting and possibly eliminating the flow of combustion gases into the fuel. This leads to reduced heat output and burning efficiency.

Accordingly, it would be desirable to provide an apparatus for the combustion of solid particulate fuel that utilizes the advantages described above with regard to a perforated grate without suffering from the drawbacks associated with the formation of ash and clinkers.

SUMMARY OF THE INVENTION

An apparatus formed in accordance with the present invention provides a means whereby solid particulate fuels can be efficiently combusted over extended periods of time without having the combustion of the fuel adversely affected by the formation of ash of clinkers. The apparatus provides a means whereby fuels, which otherwise could not be used on a stationary grate due to the excessive production of ash or clinkers during combustion, can be burned on a stationary grate without suffering from clogging or blocking of the perforations in the grate.

An apparatus formed in accordance with the present invention includes a stationary grate in the form of a perforated plate. The stationary grate supports the solid particulate fuel that is received from a fuel inlet located in a plane above the grate. Also positioned in a plane above the grate is a displaceable member whose movement causes the spent solid particulate fuel to be displaced from the stationary grate.

The apparatus may also include a burning cap defining a combustion chamber over the stationary grate. The burning cap includes a baffle that divides the combustion chamber into a primary half and a secondary half, with the primary half receiving the solid particulate fuel from the fuel inlet. The baffle includes an orifice for allowing combustion gases in the secondary half to pass into the primary half of the combustion chamber.

BRIEF DESCRIPTION OF THE DRAWINGS

The present invention will become more apparent from the following description herein when considered together with the accompanying drawings. Such drawings are set forth as being merely illustrative of the invention and are not intended in any way to be limitative thereof. It is to be understood that modifications and changes in the preferred embodiments of the invention herein described and shown may be made without departing from the spirit and scope of the present invention.

DETAILED DESCRIPTION OF THE INVENTION

Figure 1:
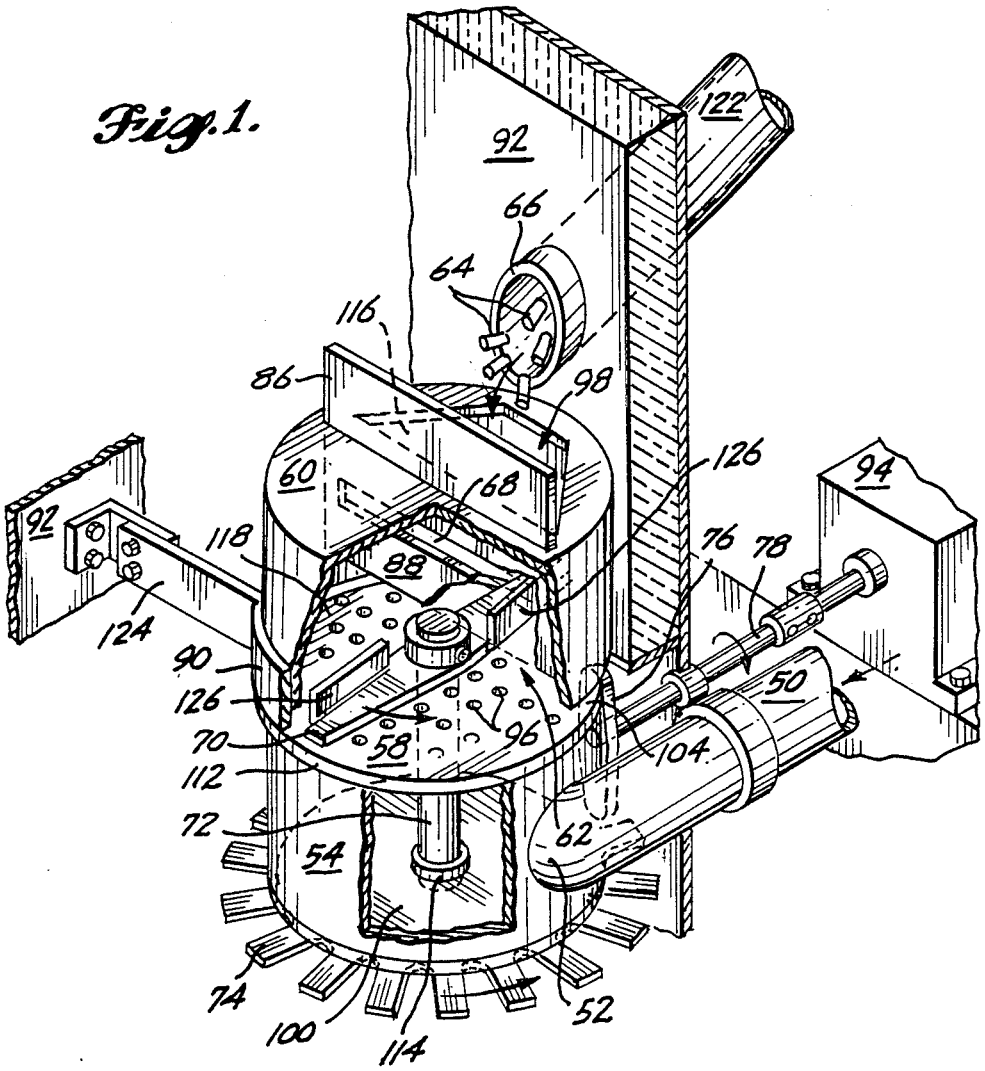
FIG. 1 is a cut-away isometric view of an apparatus formed in accordance with the present invention.
Figure 2:
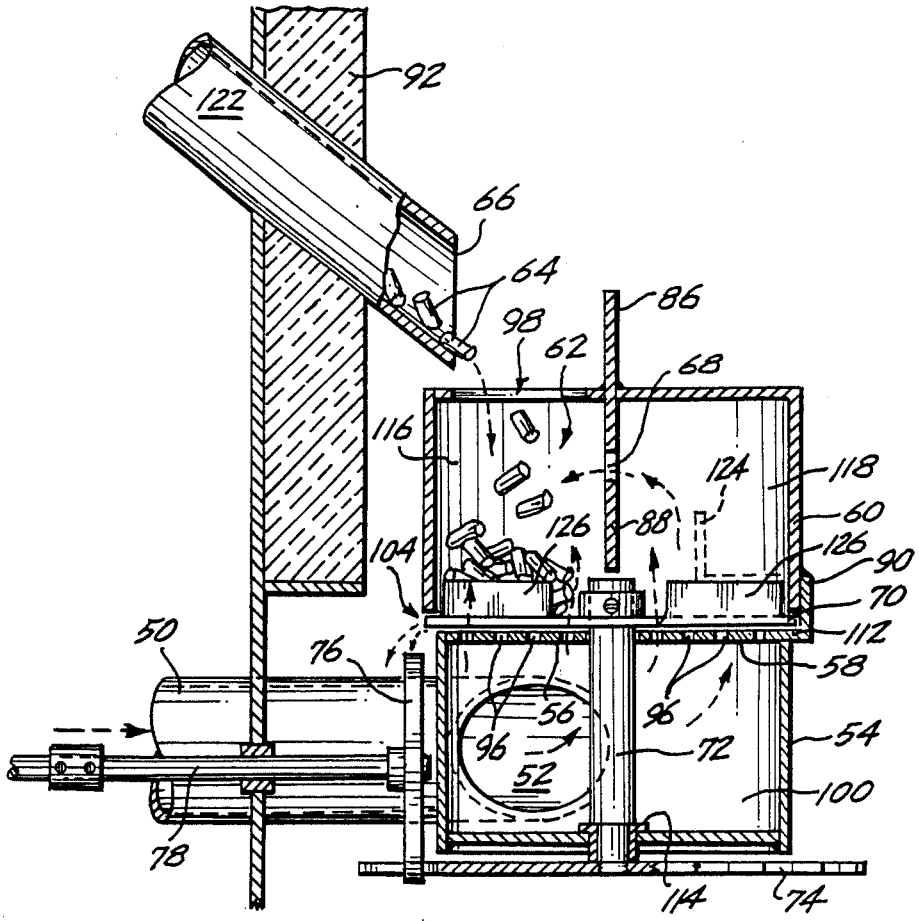
FIG. 2 is a cross-sectional view of a portion of the apparatus in FIG. 1.

Referring to FIGS. 1 and 2, an apparatus formed in accordance with the present invention includes a grate generally indicated by reference numeral 112. Grate 112 is preferably stationary and supported on top of a burn pot generally indicated by reference numeral 54. Burn pot 54 is in the shape of a cylinder having a substantially closed bottom and a substantially open top. Burn pot 54, when covered by grate 112, defines a gas chamber 100 below grate 112. Above grate 112 is positioned a burning cap generally indicated by reference numeral 60 that serves to define a cylindrical combustion chamber 62. Combustion chamber 62 is divided into two halves by a vertically oriented baffle 88. Baffle 88 is supported between opposing walls of burning cap 60 and divides combustion chamber 62 into a primary half 116 (to the rear of baffle 88 in FIG. 1) and a secondary half 118 (to the front of baffle 88 in FIG. 1). The top rear half in FIG. 1 of burning cap 60 above primary half 116 of combustion chamber 62 includes an aperture 98 for receiving solid particulate fuel 64 from a fuel inlet 66 positioned in a plane above the top of burning cap 60. Though not completely illustrated, it should be understood that an apparatus formed in accordance with the present invention is positioned within walls 92 of a conventional firebox, for example, the firebox of a stove for burning pelletized fuel.

Positioned in a plane just above grate 112 is a rotatable arm generally indicated by reference numeral 70 that, when rotated, displaces ash and clinkers that form during the combustion of solid particulate fuel 64. Rotatable arm 70 is supported just above grate 112 by a rotatable vertical shaft 72. The end of shaft 72 opposite rotatable arm 70 passes through the bottom of burn pot 54 and is supported by a bearing 114 in the bottom of burn pot 54. The end of shaft 72 outside burn pot 54 is attached to an external spur gear or sprocket, generally indicated by reference numeral 74. External gear 74 lies in a plane parallel to the bottom of burn pot 54. Gear 74 is driven by a longitudinal driver arm 76 lying in a plane perpendicular to the plane defined by gear 74. Driver arm 76 is attached to the end of a horizontal drive shaft 78 that is driven by a motor 94 positioned outside the firebox.

The apparatus formed in accordance with the present invention also includes a combustion gas supply conduit 50 that passes through wall 92 of the firebox and terminates at a combustion gas inlet 52 within the right-hand side of burn pot 54. The combustion gas will generally be air, but can include other gases that will sustain the combustion of the solid particulate fuel. In addition to providing combustion gas to burn pot 54, combustion gas supply conduit 50 may also serve to support the apparatus formed in accordance with the present invention within a firebox. In addition, support arm 124 may be attached to the periphery of burn pot 54 in order to support the apparatus between opposing walls of the firebox.

Referring to FIGS. 1 and 2 in more detail, grate 112 is preferably a circular plate lying in a horizontal plane including a plurality of perforations generally indicated by reference numeral 96. Grate 112 serves to support solid particulate fuel 64 above gas chamber 100. Perforations 96 also serve to allow combustion gas in underlying gas chamber 100 to pass upward through grate 112 and into combustion chamber 62. Perforations 96 can be provided in many different patterns in grate 112. The size of perforations 96 should be such that they are not so large as to allow solid particulate fuel 64 to pass therethrough and into gas chamber 100. On the other hand, perforations 96 should not be so small that they are easily clogged by ash, clinkers, or unburned fuel. As will be described in more detail hereinbelow, grate 112 includes a primary half generally indicated by reference numeral 56 and a secondary half generally indicated by reference numeral 58. Primary half 56 of grate 112 defines the lower boundary of primary half 116 of combustion chamber 62. Likewise, secondary half 58 of grate 112 defines the lower boundary of secondary half 118 of combustion chamber 62. Preferably, primary half 56 of grate 112 has a constant radius. Preferably, a portion of secondary half 58 has a radius that is greater than the radius of primary half 56. The incremental increase in radius of secondary half 58 of grate 112 provides a horizontal peripheral surface upon which the bottom of a vertical rib 90 sits. The upper portion of vertical rib 90 is attached to the periphery of the lower end of burning cap 60. The lower end of vertical rib 90 extends below the lower end of burning cap 60. Thus, when the bottom of vertical rib 90 sits on top of secondary half 58 of grate 112, the bottom of burning cap 60 is elevated above the upper surface of grate 112. Because rib 90 preferably extends around a portion of the periphery of burning cap 60 that corresponds to the portion of secondary half 58 that has the larger radius, and not the entire periphery of burning cap 60, a majority of the space between grate 112 and burning cap 60 is not closed off. Thus, as indicated by reference numeral 104, an opening is provided between the bottom of burning cap 60 and grate 112 to allow ash and clinkers to be displaced from grate 112. Burning cap 60 has a radius that is greater than the smaller radius of grate 112 yet less than the larger radius of grate 112. Accordingly, opening 104 between burning cap 60 and grate 112 is a horizontal and vertical opening.

Burn pot 54 that is positioned below and supports grate 112 is a generally cylindrical-shaped structure having a bottom that is substantially closed and a top that is substantially open. Burn pot 54, in conjunction with grate 112, defines gas chamber 100 that distributes combustion gas from combustion gas supply conduit 50 to the underside of grate 112. Burn pot 54 has an inner diameter that is slightly greater than the diameter of the circle that encompasses all of the perforations 96 in grate 112. This ensures that each perforation 96 in grate 112 can be utilized to allow combustion gas in gas chamber 100 to pass into combustion chamber 62. In order to attach grate 112 to the top of burn pot 54, the outer radius of burn pot 54 is less than the smaller of the two outer radius of grate 112. The closed off bottom of burn pot 54 includes conventional bearing 114 that rotatably receives vertical shaft 72. Preferably, bearing 114 is positioned in the center of the bottom of burn pot 54 and supports shaft 72 vertically so that rotatable arm 70 pivots about the center of grate 112.

Combustion gas supply conduit 50 terminates at combustion gas inlet 52 in the right-hand side of burn pot 54 in FIG. 1. Combustion gas supply conduit 50 provides combustion gases into gas chamber 100. Though not shown, the vertical sidewall of burn pot 54 in FIG. 1 can include a support for the end of drive shaft 78 that is attached to and drives driver arm 76.

Positioned above the upper surface of grate 112 is burning cap 60 that is also generally cylindrical in shape. Burning cap 60 has a bottom that is substantially open and a top that is partially open. The dimensions of burning cap 60 are such that the burning cap, in conjunction with grate 112, defines combustion chamber 62 above grate 112. As described above, the bottom of burning cap 60 is supported slightly above the upper surface of grate 112 by vertical rib 90 that is attached to a portion of the vertical sidewall of burning cap 60 that partially defines secondary half 118 of combustion chamber 62. The bottom of vertical rib 90 sits on top of the portion of grate 112 with the larger radius. Preferably, grate 112 is reversibly attached to rib 90 so that burning cap 60 and grate 112 can be separated for maintenance or inspection. It should be understood that the extent that vertical rib 90 closes opening 104 between grate 112 and burning cap 60 can vary over a wide range. For example, if only a small opening 104 between burning cap 60 and grate 112 is preferred, rib 90 can be made to extend around substantially the entire periphery of burning cap 60. On the other hand, if a larger opening is desired, rib 90 can be made to extend around only a small portion of the periphery of burning cap 60. In either case, the portion of grate 112 that has a larger radius should be coextensive with vertical rib 90 such that a horizontal surface is provided upon which to rest the bottom of rib 90. If alternative means are provided to support burning cap 60 above grate 112, it is possible that opening 104 could extend around the entire periphery of burning cap 60 and grate 112. The height of opening 104 between burning cap 60 and grate 112 may be adjusted by varying the distance rib 90 extends below the bottom of burning cap 60.

Burning cap 60 includes vertically oriented baffle 88 that divides combustion chamber 62 into primary half 116 and secondary half 118. Baffle 88 can be a vertically oriented plate that is supported between the opposing walls of burning cap 60. Baffle 88 includes an orifice generally indicated by reference numeral 68 that allows combustion gases in secondary half 118 of combustion chamber 62 to pass into primary half 116 of combustion chamber 62. The rear half of burning cap 60 in FIG. 1 includes an aperture 98 for solid particulate fuel 64 to pass into combustion chamber 62 and onto grate 112. Aperture 98 also provides an opening for the flame in combustion chamber 62. On top of burning cap 60, standing in the same plane as baffle 88, is another vertically oriented baffle 86 that serves to spread and mix the flame and deflect fuel into combustion chamber 62. The top of baffle 86 can also include a horizontal extension (not shown) that extends out and over aperture 98 and also helps to spread and mix the flame.

Still referring to FIGS. 1 and 2, rotatable arm 70, that is pivoted at its center and positioned in a horizontal plane just above grate 112, can be rotated in either a clockwise or counterclockwise direction. The rotation of arm 70 serves at least two important functions. First, when arm 70 is rotated, it sweeps across the upper surface of grate 112 and causes the spent particulate fuel in the form of ash (and clinkers) to be directed to opening 104 around the periphery of grate 112. The ash is pushed out opening 104 and falls over the side of burn pot 54 into an ash collection tray. This action prevents excessive buildup of ash on grate 112. Second, when rotatable arm 70 passes through burning solid particulate fuel 64, it serves to reduce the formation of clinkers that may result when the flame temperature is too high or the fuel contains impurities that lower the melting point of the fuel, thus allowing the spent fuel to vitrify.

Rotatable arm 70 is generally a flat longitudinal member and is supported in the center on the end of vertical shaft 72. Rotatable arm 70 can be described as having two fingers extending in opposite directions from shaft 72. Each finger may include a leading edge in the direction of rotation that is horizontal or vertical. The trailing or leading edge of the fingers may include a vertical flange 126 that extends along the length of each finger. The height of flange 126 is generally limited by the distance between the upper surface of arm 70 and the lower surface of baffle 88. In other words, the height of flange 126 must not interfere with the rotation of arm 70 as it sweeps over grate 112 and underneath baffle 88. Alternatively, arm 70 can be in the form of a continuous longitudinal L-shaped beam. When the arm is in the shape of a continuous L-shaped beam, the leading or trailing edge of one finger will comprise vertical flange 126 while the leading or trailing edge of the other finger will comprise a horizontal flange.

Preferably, when rotatable arm 70 includes at least one vertical flange, a portion of the flange(s) proximate the ends of rotatable arm 70 should be removed so that the ends of arm 70 are substantially flat. This allows the ends of arm 70 to pass through opening 104 between burning cap 60 and grate 112. The flatness of the ends of arm 70 allows the arm to sweep the portion of grate 112 that is positioned directly below the vertical sidewall of burning cap 60 that is supported just above the periphery of secondary half 58 of grate 112.

The lower end of vertical shaft 72 opposite arm 70 is attached to gear 74. Shaft 72 is supported for rotation through the bottom of burn pot 54 by conventional bearing 114. Gear 74 resembles a sprocket and can be driven by conventional means, for example, a longitudinal driver arm 76. Driver arm 76 is supported by the end of drive shaft 78 in a plane perpendicular to the plane defined by gear 74. Drive shaft 78 is driven by motor 94. Cooperation among motor 94, drive shaft 78, driver arm 76, and gear 74 should be such that the rotational speed of arm 70 is not so fast as to sweep through primary half 116 of combustion chamber 62 and put out the flame. Furthermore, the speed of arm 70 should not be so great as to remove some of the unburned particulate fuel from primary half 116 of combustion chamber 62. On the other hand, the rotational speed of arm 70 must be sufficient to ensure that the ash and clinkers are not allowed to build up and block the perforations in grate 112.

Referring primarily to FIG. 1, solid particulate fuel 64 is provided to an apparatus formed in accordance with the present invention from fuel inlet 66 at the end of fuel conduit 122 positioned in a plane above grate 112. Preferably, fuel inlet 66 is positioned so that solid particulate fuel 64 will pass through aperture 98 in burning cap 60 and fall onto primary half 56 of grate 112. In the context of providing solid particulate fuel 64 onto grate 112, baffles 86 and 88 serve as splash plates or deflection plates that direct particulate fuel 64 downward onto the upper surface of primary half 56 of grate 112. Although it is preferred that solid particulate fuel 64 be provided to fuel inlet 66 by a conventional auger means, it is also possible that solid particulate fuel 64 could be provided directly from a conventional hopper or reservoir of fuel. Another alternative of providing solid particulate fuel 64 to aperture 98 and removing spent fuel from grate 112 involves the use of a reciprocating arm and paddle as described hereinbelow correct reference to FIGS. 3 and 4.

An apparatus formed in accordance with the present invention relies upon an inductive current to supply combustion gases to combustion chamber 62. Due to the consumption of the combustion gases, normally air, by the flame, the pressure just above the upper surface of grate 112 is generally about 0.1 to about 0.5 inches of water below the atmospheric pressure. Because combustion gas supply conduit 50 is preferably vented to the atmosphere, the pressure just below grate 112 in gas chamber 100 will be atmospheric pressure. Thus, the pressure gradient in passing from gas chamber 100 into combustion chamber 62 provides a driving force for inducing the flow of combustion gases into combustion chamber 62. Because combustion chamber 62 is separated into primary half 116 and secondary half 118, there are two separate flows of combustion gases provided to the flame. First, the primary flow of combustion gas is through perforations 96 in primary half 56 of grate 112. A secondary flow of combustion gases passes through perforations 96 in secondary half 58 of grate 112 and into secondary half 118 of combustion chamber 62. From secondary half 118 of combustion chamber 62, the combustion gases pass through orifice 68 in baffle 88 and into the flame in primary half 116 of combustion chamber 62.

Although the apparatus formed in accordance with the present invention described above includes a burning cap 60, the benefits relating to removal of ash and clinkers are also realized even when burning cap 60 is not present, although the presence of burning cap 60 is certainly preferred. It should also be understood that the particular method of driving rotatable arm 70 described above is only exemplary and other mechanisms may be equally effective. It is also possible to continuously or intermittently rotate arm 70. Finally, although solid particulate fuel 64 is illustrated as falling out of fuel inlet 66 and into combustion chamber 62, it is possible that a continuous conduit could be used to guide the fuel into combustion chamber 62. If a continuous conduit is used, care must be taken to ensure that the potential for burn-back into the fuel reservoir is eliminated.

Figure 3:
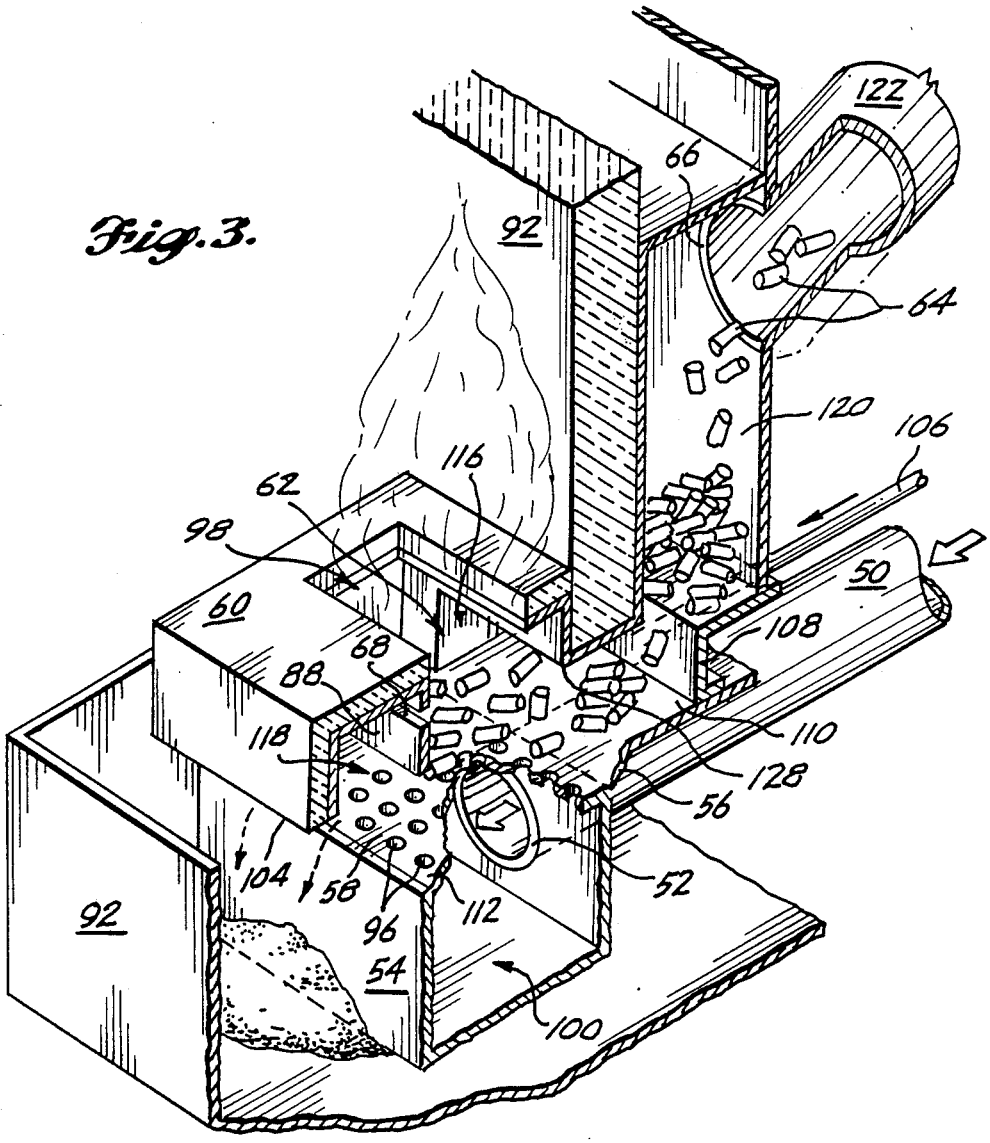
FIG. 3 is a cut-away isometric view of another apparatus formed in accordance with the present invention.
Figure 4:
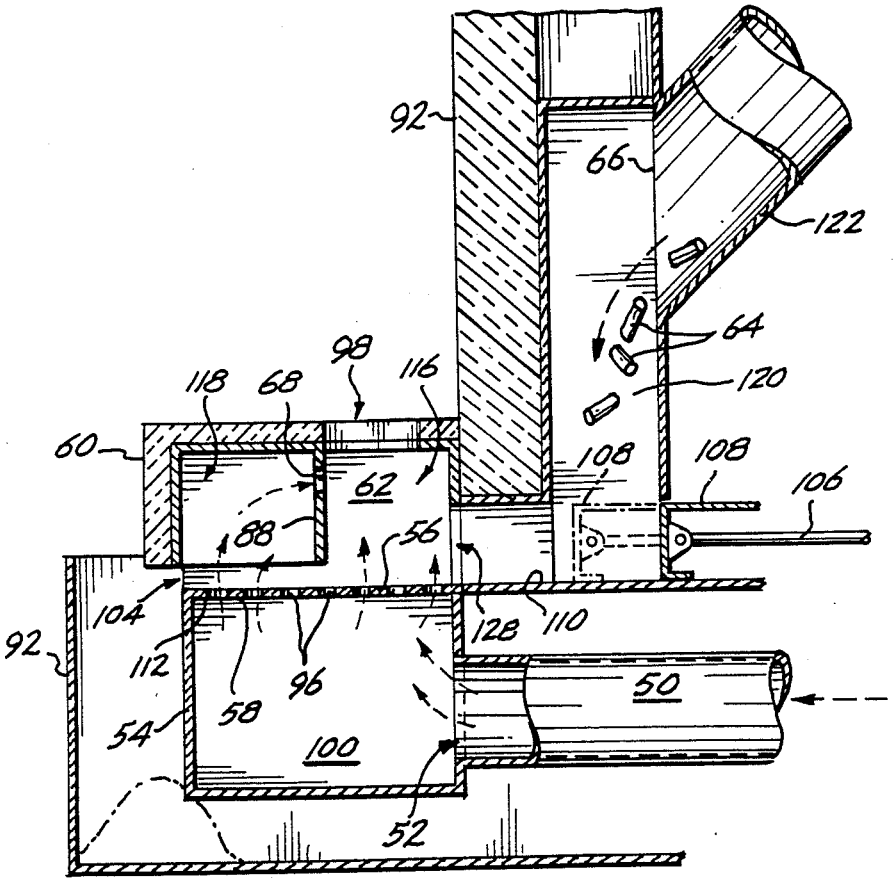
FIG. 4 is a cross-sectional view of a portion of the apparatus in FIG. 3.

Referring to FIGS. 3 and 4, where similar components are identified by the same reference numbers used in conjunction with FIGS. 1 and 2, another apparatus formed in accordance with the present invention includes a reciprocating arm 106 that horizontally reciprocates a paddle 108 that drives solid particulate fuel 64 onto and across horizontal grate 112. In this embodiment, burn pot 54 is in the shape of a rectangular box with an open top. Grate 112 is in the form of a rectangular perforated plate, which is supported on top of burn box 54. As described above, combustion gases are supplied to burn box 54 by combustion gas supply conduit 50. The combustion gases pass up through perforations 96 in grate 112 and into combustion chamber 62 located directly above burn box 54. Solid particulate fuel 64 is provided to the right-hand side of the burn plate in FIG. 3 from a horizontal feed plate 110, whose upper surface lies in the same plane as the upper surface of grate 112. Feed plate 110 is generally a flat plate having a width substantially equal to or less than the width of rectangular grate 112. Feed plate 110 passes through an opening 128 in fire wall 92 of the firebox. Opening 128 and feed plate 110 provide a passageway for solid particulate fuel 64 to enter into the firebox and onto grate 112. Solid particulate fuel 64 is provided on feed plate 110 from a vertically oriented chute 120 that is fed by a fuel conduit 122 positioned in a plane above grate 112. Paddle 108, having a width substantially equal to the width of feed plate 110 and a height substantially equal to the distance between the bottom of fire wall 92 and the top of feed plate 110, is attached to the end of horizontally reciprocating arm 106 and serves to provide the driving force to direct solid particulate fuel 64 into the firebox and onto grate 112. Paddle 108 includes a vertical front surface that serves to push solid particulate fuel 64 across feed plate 110 and grate 112. Extending from the top of the vertical front surface of paddle 108 in a rearward direction is a horizontal plate having a width substantially equal to the width of feed chute 120. The horizontal plate is at least long enough to prevent solid particulate fuel 64 from falling behind paddle 108 when the paddle is in its forwardmost position. Reciprocating arm 106 can be propelled by conventional means such as an electric motor or the like.

The stroke of reciprocating arm 106 is such that the vertical front surface of paddle 108 does not pass beneath the forwardmost wall of vertical feed chute 120. This prevents paddle 108 from crushing or grinding the solid particulate fuel between its upper front surface and the bottom of the front wall of feed chute 120. The rearwardmost position of the stroke of reciprocating arm 106 should be such that the vertical front surface of paddle 108 does not pass to the rear of the back wall of feed chute 120.

Burning cap 60 is a rectangular housing having vertical sidewalls, an open bottom, and a partially open top. The top of burning cap 60 closest to reciprocating arm 106 includes aperture 98 for allowing the flame to escape from combustion chamber 62. Each of the vertical sidewalls, with the exception of vertical sidewall 124 opposite feed plate 110, is preferably reversibly attached to or positioned directly adjacent the upper surface of grate 112 such that there are substantially no openings between the bottom of the vertical sidewalls and grate 112. The bottom of vertical sidewall 124 of burning cap 60 opposite feed plate 110 is terminated in a horizontal plane above the horizontal plane defined by the upper surface of grate 112, and accordingly, an opening 104 is provided between burning cap 60 and grate 112. Spent particulate fuel in the form of ash and clinkers can be displaced off grate 112 through opening 104 and into an ash collection tray within the firebox. Alternatively, vertical sidewall 124 may lie in a vertical plane to the left (in FIG. 4) of the vertical plane defined by the wall of burn pot 54 opposite combustion gas inlet 52.

Similar to burning cap 60 described in FIGS. 1 and 2, burning cap 60 in FIGS. 3 and 4 defines a combustion chamber 62 above grate 112. Combustion chamber 62 is divided into primary half 116 secondary half 118 by vertically oriented baffle 88 that extends across combustion chamber 62 in a direction perpendicular to the direction in which reciprocating arm 106 is displaced. The bottom of baffle 88 is positioned above the upper surface of grate 112 so that the ash and clinkers resulting from the combustion of solid particulate fuel 64 can pass underneath baffle 88 and across and off grate 112. The upper portion of baffle 88 includes orifice 68 that allows combustion gas in secondary half 118 of combustion chamber 62 to pass into primary half 116 of combustion chamber 62.

As with the apparatus described in conjunction with FIGS. 1 and 2, the apparatus in FIGS. 3 and 4 through the operation of reciprocating arm 106 and paddle 108, provides a means for removing ash and clinkers from the upper surface of grate 112 that would otherwise build up on grate 112 and block perforations 96. As paddle 108 directs fuel onto grate 112, spent fuel is pushed off of the grate.

Solid particulate fuel 64 that is burned in an apparatus formed in accordance with the present invention may be any type of pelletized fuel known in the art. Examples of such fuel include pelletized wood waste, agricultural residue, paper, coal dust, garbage, and the like. Preferably, the pelletized fuel is wood. The apparatus formed in accordance with the present invention is particularly useful when the pelletized fuels that are burned are of the type that have been produced by processes or from materials that result in the production of large amounts of ash or large amounts of clinkers. For example, pelletized fuel that include silica are known to produce large amounts of ash upon combustion compared to pelletized fuels that do not contain silica.

An apparatus formed in accordance with the present invention may be made from materials that are compatible with the combustion of particulate fuel within an enclosed chamber. Preferably, the materials are of metallic compositions, and most preferably, the metallic composition is cast iron. The particular choice of materials will be dependent upon cost factors, heat and corrosion resistance, and machinability, among other things.

Although the present invention has been described in a specific form and as operating in a specific manner for the purposes of illustration, it is to be understood that the invention is not limited thereto. Various modifications will suggest themselves to those skilled in the art without departing from the spirit of this invention, the scope of which is set forth in the following claims.

The embodiments of the invention in which an exclusive property or privilege is claimed are defined as follows:

1. An apparatus for the combustion of solid particulate fuel comprising:

a stationary grate including a perforated plate for receiving said solid particulate fuel;

displaceable means positioned in a plane above said grate, movement of said displaceable means displacing spent solid particulate fuel from said stationary grate, said displaceable means including a rotatable member; and a burning cap positioned over said stationary grate, said burning cap defining a combustion chamber above said stationary grate, said burning cap including a baffle that divides said combustion chamber into a primary half and a secondary half, said burning cap also including an aperture for allowing said solid particulate fuel to be introduced into said primary half.

2. The apparatus of claim 1, wherein movement of said displaceable means deters the formation of solid clinkers upon combustion of said solid particulate fuel.

3. The apparatus of claim 1, further comprising:

means for introducing combustion gas below said stationary grate such that said combustion gas may pass through said stationary grate into said primary half and said secondary half of said combustion chamber, said baffle including an orifice for allowing combustion gas in said secondary half to pass into said primary half.

4. The apparatus of claim 3, wherein said baffle maintains substantially all of said solid particulate fuel within said primary half of said combustion chamber.

5. The apparatus of claim 1, further comprising a solid particulate fuel inlet positioned in a plane above said stationary grate.

6. The apparatus of claim 1, wherein said spent solid particulate fuel is selected from the group consisting of ash and clinkers.

7. The apparatus of claim 6, wherein said solid particulate fuel is selected from the group consisting of pelletized wood, waste, agricultural residue, paper, coal dust, and garbage.

8. The apparatus of claim 1, further comprising an opening between said burning cap and said stationary grate, said spent solid particulate fuel being displaced from said stationary grate through said opening.

9. The apparatus of claim 1, further comprising an opening between said burning cap and the portion of said stationary grate within said primary half of said combustion chamber, said spent solid particulate fuel being displaced from said stationary grate through said opening by said displacement of said rotatable member.

10. An apparatus for the combustion of solid particulate fuel comprising:

a stationary grate including a perforated plate for receiving said solid particulate fuel;

displaceable means positioned in a plane above said grate, movement of said displaceable means displacing spent solid particulate fuel from said stationary grate, said displaceable means including a reciprocating member; and a burning cap positioned over said stationary grate, said burning cap defining a combustion chamber above said stationary grate, said burning cap including a baffle that divides said combustion chamber into a primary half and a secondary half, said burning cap also including an aperture for allowing said solid particulate fuel to be introduced into said primary half.

11. The apparatus of claim 10, further comprising:

means for introducing combustion gas below said stationary grate such that said combustion gas may pass through said stationary grate into said primary half and said secondary half of said combustion chamber, said baffle including an orifice for allowing combustion gas in said secondary half to pass into said primary half.

12. The apparatus of claim 10, further comprising an opening between said burning cap and said stationary grate, said spent solid particulate fuel being displaced from said stationary grate through said opening.

13. The apparatus of claim 10, wherein said spent solid particulate fuel is displaced from the portion of said stationary grate within said secondary half of said combustion chamber by said displacement of said reciprocating member.

14. The apparatus of claim 10, wherein movement of said displaceable means deters the formation of solid clinkers upon combustion of said solid particulate fuel.

15. The apparatus of claim 11, wherein said baffle maintains substantially all of said solid particulate fuel within said primary half of said combustion chamber.

16. The apparatus of claim 10, further comprising a solid particulate fuel inlet position in the plane above said stationary grate.

17. The apparatus of claim 10, wherein said spent solid particulate fuel is selected from the group consisting of ash and clinkers.

18. The apparatus of claim 17, wherein said solid particulate fuel is selected from the group consisting of pelletized wood, waste, agricultural residue, paper, coal dust, and garbage.

* * * * *